US006523196B1

(12) United States Patent
Kuno et al.

(10) Patent No.: US 6,523,196 B1
(45) Date of Patent: Feb. 25, 2003

(54) SHIBORI CLOTHES MANUFACTURING METHOD, ETC. AND SHIBORI CLOTHES MADE BY SAID MANUFACTURING METHOD

(75) Inventors: Tsuyoshi Kuno, Nagoya (JP); Hideo Saito, Sohka (JP)

(73) Assignee: Aramido Corporation, Tokyo (JP)

( * ) Notice: Subject to any disclaimer, the term of this patent is extended or adjusted under 35 U.S.C. 154(b) by 0 days.

(21) Appl. No.: 09/530,080

(22) PCT Filed: Sep. 29, 1999

(86) PCT No.: PCT/JP99/05326

§ 371 (c)(1),
(2), (4) Date: Aug. 3, 2000

(87) PCT Pub. No.: WO01/22841

PCT Pub. Date: Apr. 5, 2001

(30) Foreign Application Priority Data

Sep. 29, 1999 (WO) ..... PCT/JP99/05326
Nov. 30, 1999 (JP) ..... 11-340825

(51) Int. Cl.[7] ..... D06P 5/00
(52) U.S. Cl. ..... 5/482; 5/494
(58) Field of Search ..... 428/174, 181; 66/169 R; 12/142 G; 33/11; 2/69, 76, 256, 274; 8/482, 494, 933; 223/28, 37; 264/257

(56) References Cited

U.S. PATENT DOCUMENTS 6,174,336 B1 * 1/2001 Kondo ..... 8/482

FOREIGN PATENT DOCUMENTS

JP 2-19561 1/1990
JP 5-98587 4/1993

OTHER PUBLICATIONS

*Hi Fashion*, Tokyo, May 1996, No. 251, p. 47.

* cited by examiner

*Primary Examiner*—Donald J. Loney
(74) *Attorney, Agent, or Firm*—Nixon Peabody LLP; Thomas W. Cole

(57) ABSTRACT

A method of manufacturing shibori clothes of the desired form and hue in a secure and stable manner by application of measures taken to intentionally leave relief-like shapes called "shibo" (crimps) in the clothes and to provide new types of shibori clothes with unique forms, stretchability, handling and draping qualities, comfort when worn, etc. In a shibori clothing manufacturing method[, comprising] that includes at least a "shibori (binding) process," in which numerous portions of a dyed and sewn cloth are bound partially with a thread, a "setting process," which has at least a "steam setting process" by which the shibori cloth, obtained by the "shibori (binding) process" is exposed to steam in order to maintain the shibori (bound) shapes, and a "thread removal process," in which the abovementioned thread is removed after the "setting process", and shibori clothes made by this method.

7 Claims, 10 Drawing Sheets

("SETTING PROCESS" FOR THE CASE OF CLOTH MADE OF SYNTHETIC TEXTILE)

("SETTING PROCESS" THAT CAN BE EMPLOYED IN THE CASE OF CLOTH MADE OF SILK, COTTON, OR HEMP)

("SETTING PROCESS" FOR THE CASE OF CLOTH MADE OF WOOL)

("SETTING PROCESS" THAT CAN ONLY BE EMPLOYED IN THE CASE OF CLOTH MADE OF COTTON OR HEMP)

(PRINT DYEING PROCESS)

SHIBORI CLOTHES MANUFACTURING METHOD, ETC. AND SHIBORI CLOTHES MADE BY SAID MANUFACTURING METHOD

BACKGROUND OF THE INVENTION

1. Field of the Invention

The present invention concerns a shibori clothes manufacturing method, with which crimps are formed in a cloth by application of the binding technique of "shibori dyeing" (tie-dyeing), which is a traditional Japanese dyeing method, shibori clothes made by this manufacturing method, and a dyeing method favorable for the manufacturing method.

2. Description of the Related Art

There is a traditional Japanese dyeing technique called the "shibori dyeing" method, which is used to dye kimonos. With this technique, dyeing is performed after forming relief-like shapes called "shibo" (crimps) by pinching and binding the cloth with thread or other suitable method to prevent the entry of dye solution at parts of the cloth. Representative examples include kanoko (dappled) shibori, Arimatsu shibori, etc.

The techniques of binding the cloth used in shibori dyeing have been mostly handed down as special pattern expression techniques that made use of the differences in the degrees of dyeing of bound cloth portions and unbound cloth portions.

FIG. 10 schematically shows the "shibori (binding) process" of such "shibori dyeing" techniques and this process is characterized in binding the cloth prior to the dyeing process.

SUMMARY OF THE INVENTION

If shibori (bound) shapes can be formed intentionally using the above-described binding technique in the "shibori dyeing" techniques, it may become possible to provide clothes which have various forms of crimps (gathers) that exhibit new types of handling and draping qualities and with which the stretchability of the crimped portions provide woven clothes with body fitting qualities similar to those of knitted clothes.

However, in manufacturing clothes using such "shibori" techniques, particularly in cases where a polyester textile is employed for the cloth and print dyeing is performed, migration and sublimation of the dye tended to occur readily due to the heat of the steam in the shibori "setting process." There was thus the danger of loss of commercial value.

The objects of the present invention are therefore to (1) provide methods of manufacturing shibori clothes of the desired form and hue in a secure and stable manner by application of the above-described "shibori" techniques of "shibori dyeing" and taking measures to intentionally leave the relief-like shapes called "shibo" (crimps) in the clothes, which are the final products, (2) to apply a dyeing method that can effectively prevent migration and sublimation to shibori techniques, and (3) to provide new types of shibori clothes with unique forms, stretchability, handling and draping qualities, comfort when worn, etc.

In order to achieve the above objects, the following means are employed in the present invention.

The shibori clothes manufacturing method in accordance with the invention includes at least:

(1) a "shibori (binding) process," in which a dyed and sewn cloth is bound partially at several locations by thread, (2) a "setting process, " having at least a steam setting process in which the bound cloth obtained in the "shibori (binding) process" is exposed to steam to maintain the shibori (bound) shapes, and (3) a "thread removing process," in which the abovementioned thread is removed.

With this manufacturing method, crimps (gathers) can be formed and maintained in the clothes, which are the final products, by the shibori shapes formed in the "shibori (binding) process."

Here, "shibori" refers to the forming of crimped, relief-like shapes on cloth by a suitable method. For the abovementioned "shibori (binding) process," shibori methods, such as pinching the cloth partially so as to form a peak and then binding the base part of the peak with thread, etc. can be applied. With this shibori method, numerous, peak-shaped, relief-like crimps with relatively large differences in level can be formed on the cloth.

With another shibori clothes manufacturing method in accordance with the invention, the abovementioned "shibori (binding) process" is performed by pleating and then crimping (gathering) the cloth using a sewing needle.

With this manufacturing method, since finer crimps can be formed at a higher density than is possible with methods in which the cloth is bound at parts with thread, shibori clothes can be manufactured that are distinctive in form and are provided with unique handling and draping qualities and comfort when worn.

With yet another shibori clothes manufacturing method in accordance with the invention the abovementioned "shibori (binding) processes" may be performed by forming the bound portions successively in progression not in an oblique direction of the abovementioned cloth but in the left-right direction of the cloth.

With this manufacturing method, since the bound portions are successively formed in progression in the left-right direction of the cloth and distortion and warping are thus prevented from occurring in the "setting process," the clothes become flat, and thus, readily arranged and aligned. The clothes are thus made convenient for transport, storage, and maintenance. Furthermore, since the clothes can stretch in all directions and will be especially stretchable in the left-right direction, shibori clothes with a high degree of comfort when worn can be provided.

With still another dyeing method in accordance with the invention, a cloth comprised of cation-dyeable polyester, which has been print-dyed or immersion-dyed with a dispersion-type cationic dye, is used to perform dyeing.

By this method, the migration and sublimation of the dye can be effectively prevented even in clothes manufacturing processes in which various heat treatment processes, including a hot steam setting process, are performed after print dyeing or immersion dyeing.

This method is favorable since, for example, even if the dyed cloths are layered in two, three, or more layers and then exposed to steam in the shibori process, the colors will not be transferred among the cloths and reversible shibori clothes can thus be manufactured readily.

"Cation-dyeable polyester" refers to polyester that can be dyed readily with a cationic dye and is generally distinguished from polyester that can be dyed readily with regular dye. "Print dyeing process" refers to the method of dyeing patterns on the cloth using a screen, etc. and "immersion dyeing process" refers to the method of dyeing the cloth by immersion of the cloth itself in a dyeing solution at a prescribed temperature.

With yet a further shibori clothes manufacturing method in accordance with the invention, the cloth made of cation-dyeable polyester as previously described is sewn and the abovementioned "shibori (binding) process" is performed on this sewn cloth.

With this manufacturing method, migration and sublimation of the dye from a dark-colored portion to a light-colored portion of the cloth on which a pattern has been formed by print dyeing can be effectively prevented. Shibori clothes, with a vivid pattern and with which the occurrence of color migration, which can take the appearance of soiling of the light-colored portions, is prevented, can thus be manufactured.

With still a further shibori clothes manufacturing method in accordance with the invention, when the cloth of the abovementioned methods is formed from natural textile, the "setting process" is comprised only of the "steam setting process." With another shibori clothes manufacturing method in accordance with the invention, when the abovementioned cloth is formed from wool, the "setting process" for maintaining the shibori (bound) shapes is performed by successively performing the respective processes of solution immersion, drying, and steam setting. With still another shibori clothes manufacturing method in accordance with the invention, when the abovementioned cloth is made from cotton or hemp, the "setting process" for maintaining the shibori (bound) shapes is performed by successively performing the respective processes of solution immersion, water rinsing, neutralization, and drying.

With these shibori manufacturing methods, shibori clothes, which do not become starchy and have soft handling and draping qualities, can be made even when cloths formed from various natural textile materials are used.

Since the shibori clothes of the ninth claim are made by a shibori clothes manufacturing method as previously set forth in any of the first, second, third, fifth, sixth, seventh and eighth methods, the shibori clothes will be clothes with which numerous crimps, formed by partially binding numerous portions of a dyed and sewn cloth, are maintained on the cloth.

With such shibori clothes, forms with unique relief-like shapes will be maintained and these shapes will not degrade even upon water rinsing at low temperature. Also, since the clothes will have the soft handling and draping qualities for kimonos and will have a high level of stretchability, the clothes will be new types of clothes that fit well on the body and be high in comfort when worn. Furthermore, since such shibori clothes will be in the shrunken condition prior to wearing, they will be convenient to carry.

Also, with the shibori clothes made by the abovementioned fifth manufacturing method, since patterns can be formed with the migration and sublimation of dye being prevented, the commercial value of the clothes will be extremely high.

As is clear from the above description, with the abovementioned first or second shibori clothes manufacturing method, desired forms of crimp (gathers) can be formed without fail in a stable manner on clothes, which are the final products, by subjecting the cloth with shibori shapes formed in the "shibori (binding) process" to the prescribed "setting process."

Moreover, by using the "thread tying method" or the "pleating method" as the shibori method and by taking further measures concerning the shibori density and degree of shibori, crimps of distinctive forms can be formed on clothes to enable the diversification of products.

Also, by forming the shibori in progression in the left-right direction of the cloth as in the abovementioned third manufacturing method, since distortion and warping will be completely prevented from occurring in the setting process, not only will the clothing on which shibori has been formed be flat, easy to arrange and align, and convenient to transport and store but shibori clothing can be manufactured that stretch and shrink uniformly in the vertical and left-right directions and are thus comfortable to wear.

With the abovementioned fourth print dyeing method, since a dyeing means, which uses cloth made from cation-dyeable polyester that has been print dyed or immersion dyed by a dispersion-type cationic dye, is employed, dye migration and sublimation can be effectively prevented and clothes of vivid coloration can be provided even with a clothes manufacturing process in which various heat treatment processes are applied after the dyeing process.

By sewing the cloth made of cation-dyeable polyester of the abovementioned fourth print dyeing method and subjecting this cloth to the "shibori (binding) process" of any of the first to third methods, the migration and sublimation of dye from a dark colored portion to a light colored portion of the cloth on which a pattern has been formed by print dyeing can be effectively prevented and shibori clothes, with a vivid pattern and with which color migration, which can take the appearance of soiling marks, into a light colored portion is prevented, can be manufactured. The added value of shibori clothes can thus be increased.

In the case where a cloth made of natural fiber is to be used, by taking the measures of any of the abovementioned sixth to eight manufacturing methods, shibori clothes, which have soft handling and draping qualities and are not starchy, can be made without fail even from cloth made of wool, cotton or hemp.

Since the shibori clothes made by the shibori clothes manufacturing methods of this invention have the desired shapes and coloration as well as unique forms, stretchability, handling and draping qualities, comfort when worn, etc., they are of extremely high commercial value.

DETAILED DESCRIPTION OF THE INVENTION

Figure 1:
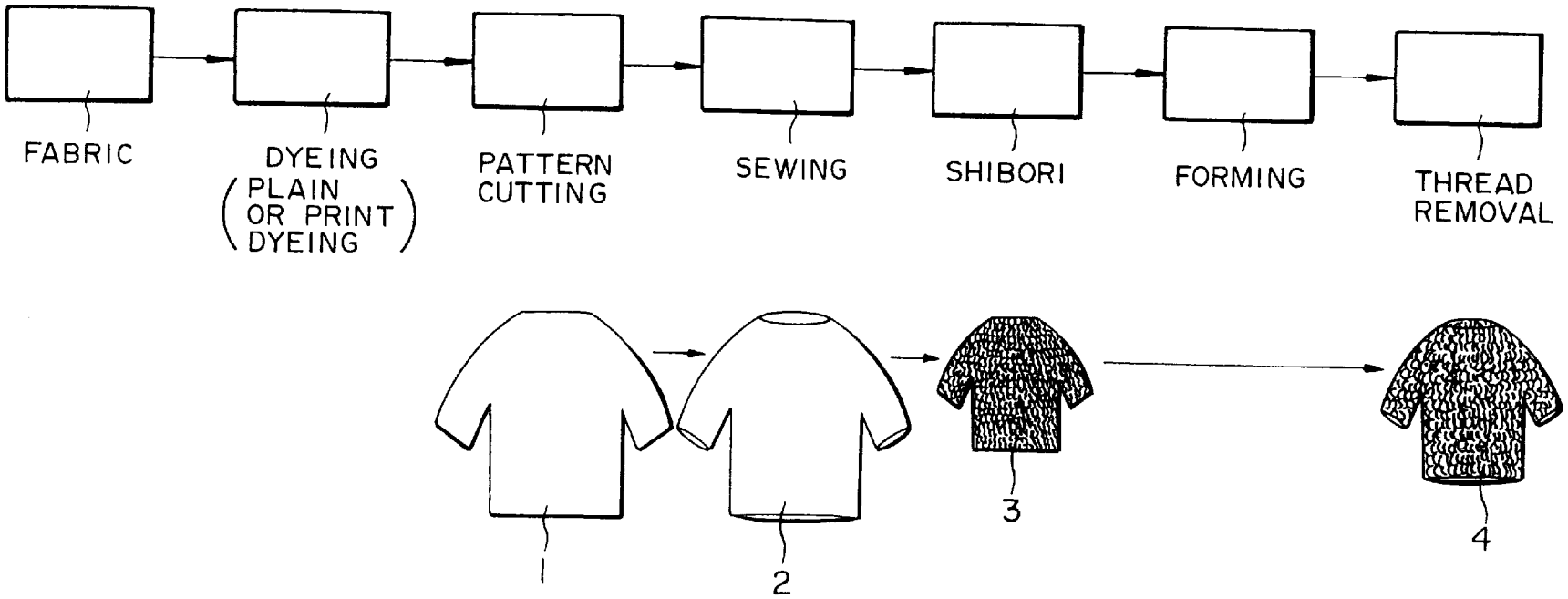
FIG. 1 is a diagram which schematically shows the flow of the manufacturing processes of the "shibori clothes manufacturing method" of this invention.

Preferred embodiments of this invention shall now be described in detail with reference to the attached drawings. First, based on FIG. 1 through FIG. 3, the manufacturing process of the "shibori clothes manufacturing method" of this invention shall be described briefly.

A fabric made from a synthetic textile, such as polyester textile, acrylic textile, nylon textile, etc., or a natural textile, such as silk, hemp, cotton, wool, etc., is selected as suitable and after dyeing with a suitable dye, the fabric is cut into a pattern 1 that matches the desired clothing shape and then sewn. This sewn cloth 2 must be formed to be of a considerably large size in view that the final product obtained from this manufacturing process will be a shibori clothing 4 having numerous crimps (shibori) 5.

A portion of the sewn cloth 2 is then pinched and raised in peak-like form, and using the method of tying and strongly binding the base portion of this peak with a thread to form a crimp 5*a* (this method shall be referred to hereinafter as the "thread tying method"), the shibori (binding) work is performed continuously by free hand (see FIG. 2(B)) to form crimps 5*a* across the entire surface of sewn cloth 2 (this process shall be referred to hereinafter as the "shibori (binding) process").

Figure 2A:
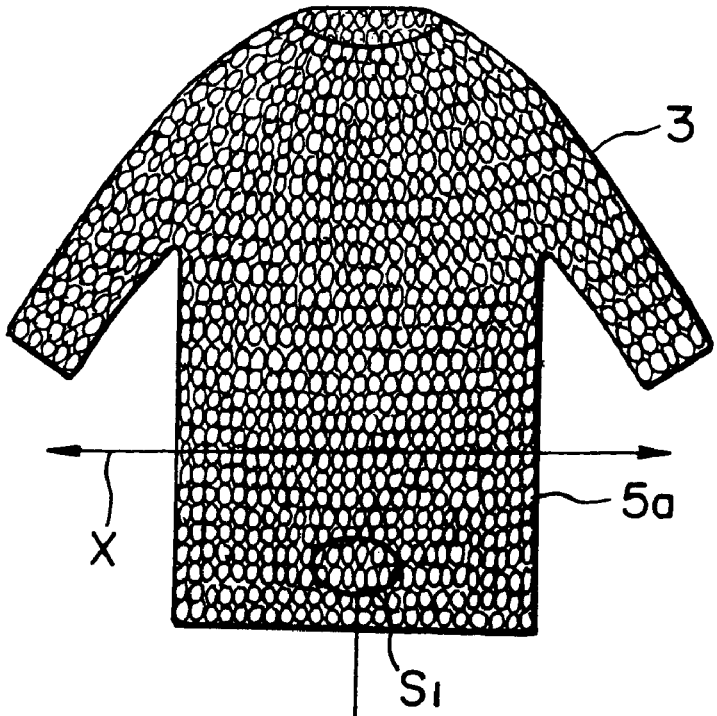
FIG. 2(A) is a diagram which shows the condition of the clothing after the "setting process" (prior to the thread removal process) of the same manufacturing process.
Figure 2B:
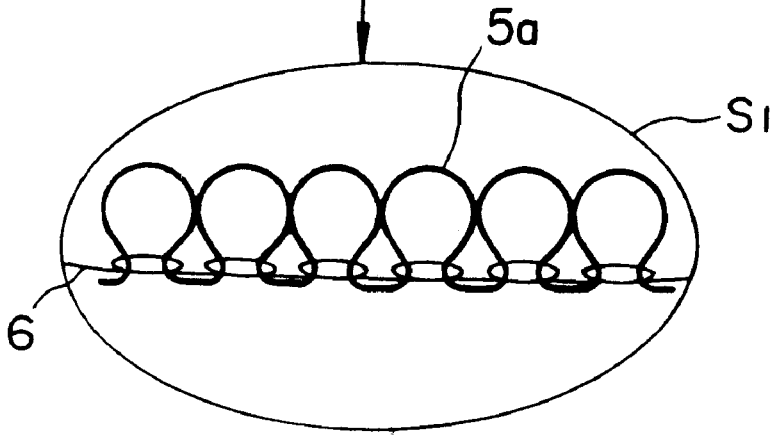
FIG. 2(B) is a diagram which shows the condition of the clothing after the "setting process" (prior to the thread removal process) of the same manufacturing process in enlarged manner.
Figure 6A:
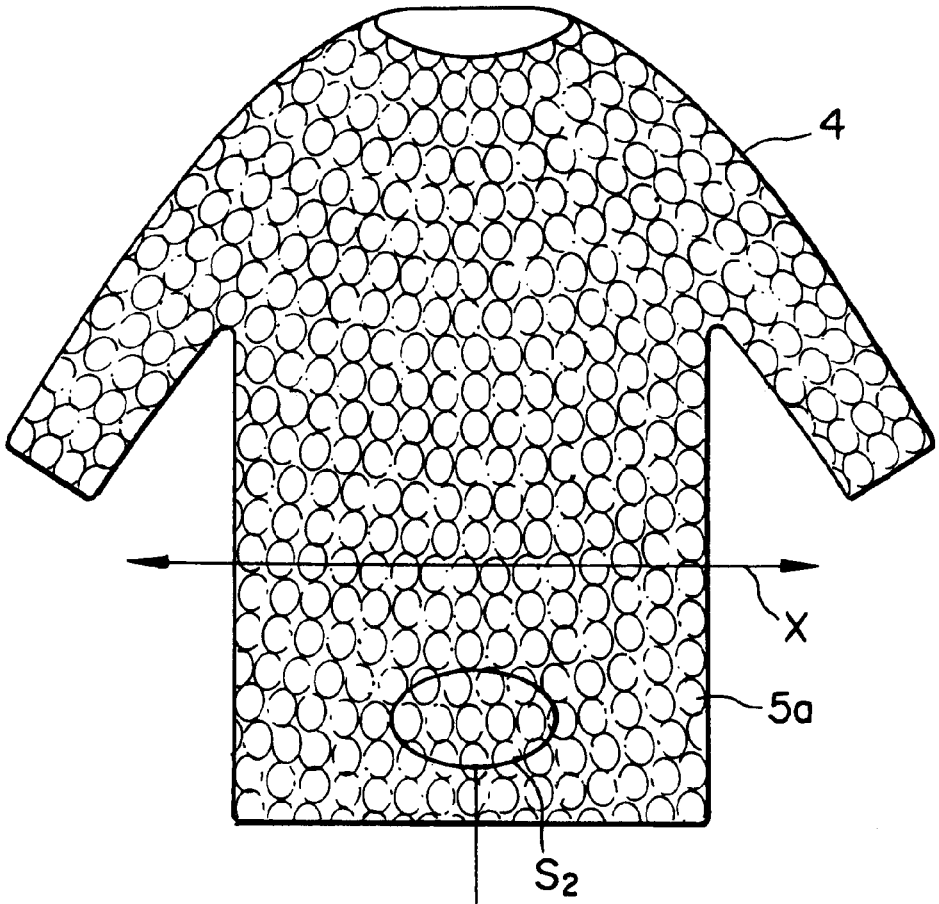
FIG. 6(A) is a diagram which shows the conditions of shibori clothing, which is the final product made by the "shibori clothes manufacturing method" of this invention.
Figure 6B:
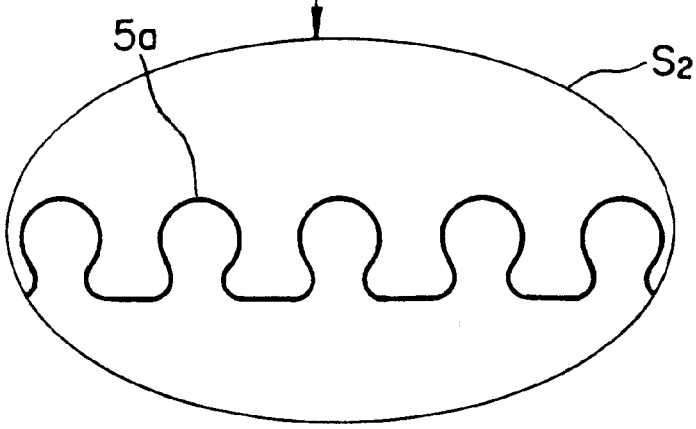
FIG. 6(B) is a diagram which shows the shibori shapes (in the condition after thread removal) of the same clothes in an enlarged manner.
Figure 7A:
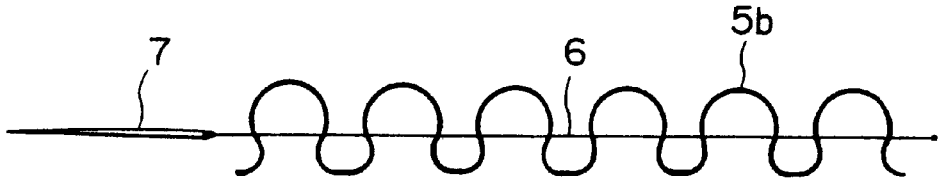
FIG. 7(A) to 7(D) are diagrams which schematically show the flow of the second embodiment of the "shibori (binding) process" of the same manufacturing process.
Figure 7B:
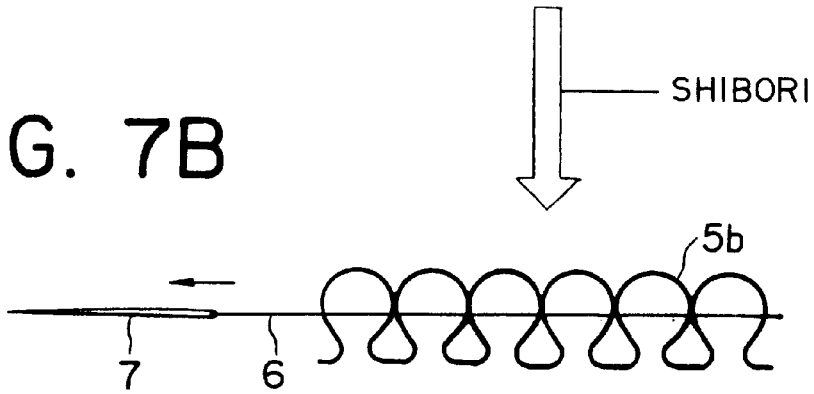
Figure 7C:
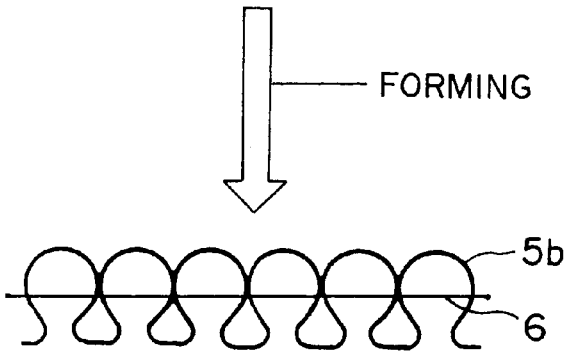
Figure 7D:
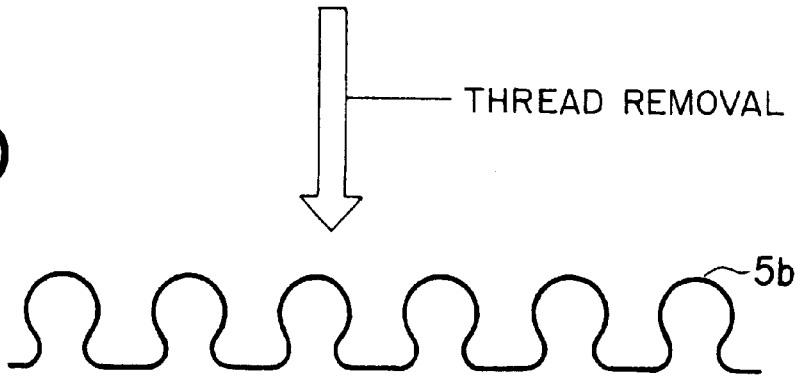

In this "shibori (binding) process," crimps 5*a* are preferably formed not obliquely with respect to cloth 2 but in the left-right direction (the direction X shown in FIGS. 2(A) and 6(A)). This is because by forming crimps 5*a* so as to progress in the left-right direction of cloth 2, the tension applied to cloth 2 can be distributed uniformly in the left-right direction (X direction) to thereby prevent the occurrence of distortion and warping in the shibori clothing 4, which is the final product.

That is, by shibori forming in the left-right direction, the shibori clothing 4, which is the final product, will be finished to have a flat shape. The clothing will thus be extremely convenient to handle as it will be easy to arrange and align and enable efficient transport and storage.

Furthermore, by forming crimps 5*a* in the left-right direction, the shibori clothing 4, which is the final product, will have uniform stretchability in the left-right direction and thus be extremely comfortable to wear.

As the shibori technique in the "shibori (binding) process," the present inventor proposes the method illustrated in FIG. 7 (this method shall be referred to hereinafter as the "pleating method") in addition to the "thread tying methods (see FIG. 2) described above. With the "pleating method," which can be called the second embodiment of the shibori forming method, the cloth is first pleated at a suitable length by a thread 6 that has been inserted through the eye of a sewing needle 7 (see FIG. 7(A)). The cloth is then gathered in a fixed direction (direction opposite to the direction of progress of pleating) to form crimps 5*b*.

Figure 8:
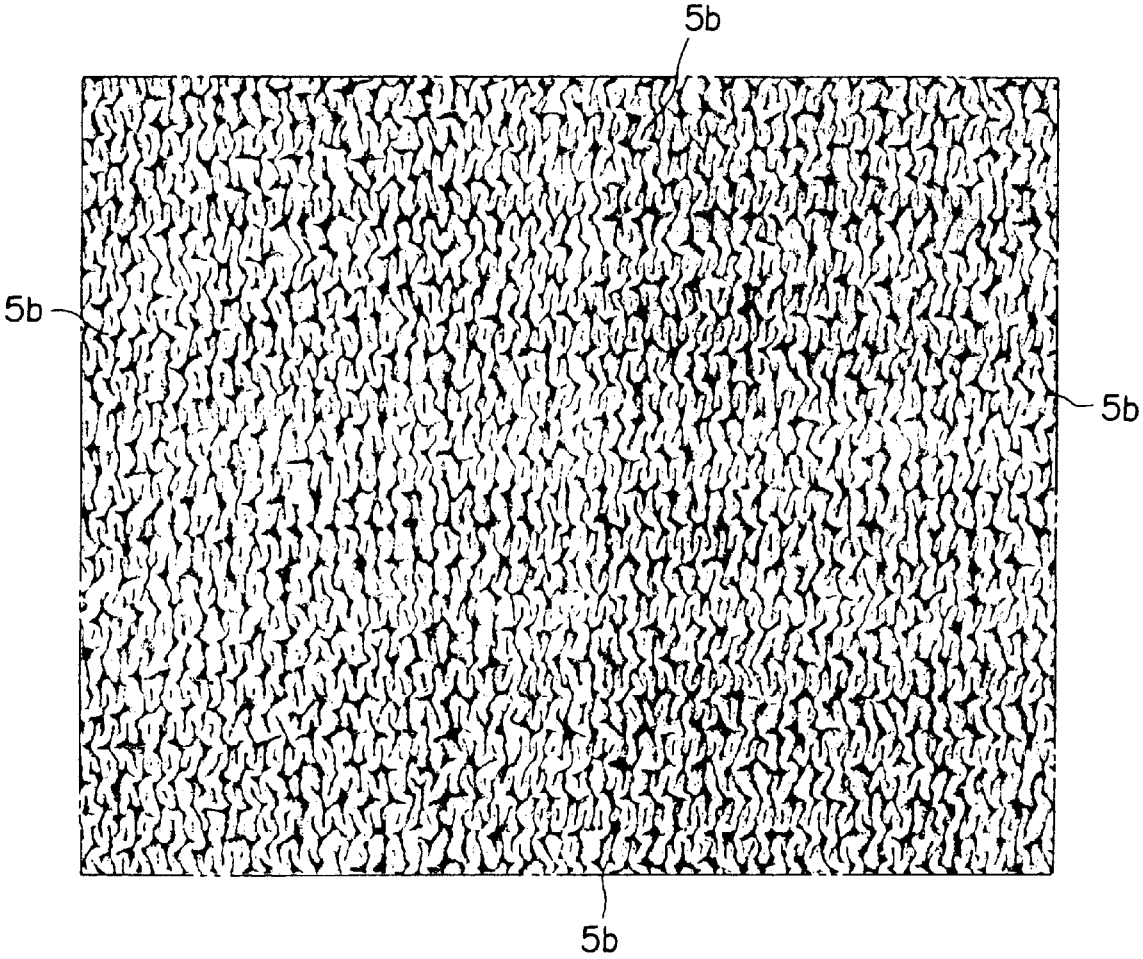
FIG. 8 is a diagram which shows the conditions of the shibori shapes formed by the "shibori (binding) process" by the "pleating method," which is the second embodiment.

With this pleating method, since numerous fine crimps can be formed densely as shown in FIG. 8, shibori clothes, which exhibit fine handling and draping qualities and shapes that differ from those provided by the above-described "thread tying method," can be provided to enable distinctions in form (see FIG. 8).

After the forming of crimps 5*a* or crimps 5*b* over the entire surface of sewn cloth 2 by the "thread tying method" or "pleating method" in the above-described "shibori (binding) process" has been completed, the "setting process" (to be described below) is performed to enable the shapes of crimps 5*a* or 5*b* to be maintained in the final product, that is, to fix the shibori shapes.

After this "setting process," all of the threads 6 that have been keeping the shibori shapes are removed ("thread removing process") to obtain the shibori clothing 4, which is the final product.

Figure 3:
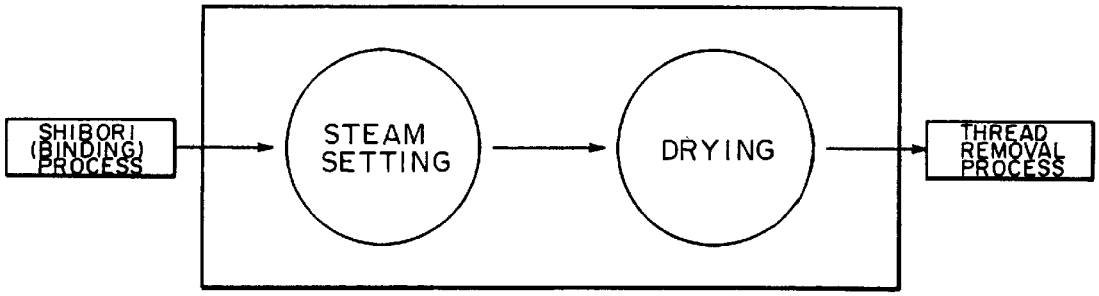
FIG. 3 is a diagram which schematically shows the flow of the "setting process" for a cloth made of synthetic textile in the same manufacturing process.

Detailed descriptions of the "dyeing process" and the "setting process" in the abovementioned manufacturing process shall now be given with reference mainly to FIG. 3 and FIG. 4 for the case where a synthetic textile has been plain dyed and the case where a synthetic textile has been print dyed, respectively.

Generally, in the case where a cloth is employed with which "plain dyeing" (dyeing with a single color) is applied to polyethylene, nylon, or other thermoplastic synthetic textiles, the "dyeing process" is performed by the immersion dyeing process in which the cloth is immersed in a dye solution.

The "setting process," which is performed after this dyeing process and the above-described "shibori (binding) process" have been performed, is mainly comprised of a "steam setting process" and a "drying process" (see FIG. 3).

First, the "steam setting process" is performed by wrapping the entire shibori cloth 3, obtained by the "shibori (binding) process" and then wrapping the cloth from above the paper with a film of polyethylene, etc. and loading this wrapped cloth into an unillustrated steam oven.

The steam temperature of the steam oven is set to 125° C. to 135° C., preferably 130° C., and the cloth is exposed to the steam for 15 to 20 minutes continuously. Then, after cooling adequately, the cloth is taken out from the steam oven and preferably subject to natural drying or tumbler drying. Tumbler drying refers to the technique of heat drying the cloth while rotating the cloth.

If, in this case where a cloth is plain dyed by the immersion dyeing process, a cloth that has been formed by a cation-dyeable polyester is dyed (immersion dyed) by immersion in a dispersion-type cationic dye solution, the migration and sublimation of the dye will be unlikely to occur. "Migration and sublimation" refers to the phenomenon where a dark-colored dye is affected by heat treatment, etc. and leaches out and migrates to a lighter colored portion of the cloth.

The above-described process is favorable in that a dark-colored dye will not migrate to a cloth (portion) that has been dyed with a lighter colored dye even when a plurality of sheets of dyed cloth are overlaid on top of each other and subject to a heat treatment process, which is essential for a shibori (binding) process, crushed crimp process, or other crimp setting process.

"Crushed crimp process" refers to the process in which a single cloth or a plurality of cloths are heat treated while being packed in a prescribed net or box to form and fix crimps on the clothing, which is the final product.

In cases where a pattern is to be formed on a cloth made of thermoplastic synthetic textile by print dyeing, further measures must be taken regarding the various conditions of the above-described "dyeing process."

This is because if in the case of a cloth with a print-dyed pattern, the migration and sublimation of the dye occurs due to the heat (steam) of the "steam setting process" in the "setting process" and the pattern becomes damaged, the commercial value of the clothing will drop. The migration and sublimation of the dye must therefore be effectively prevented.

Figure 9:
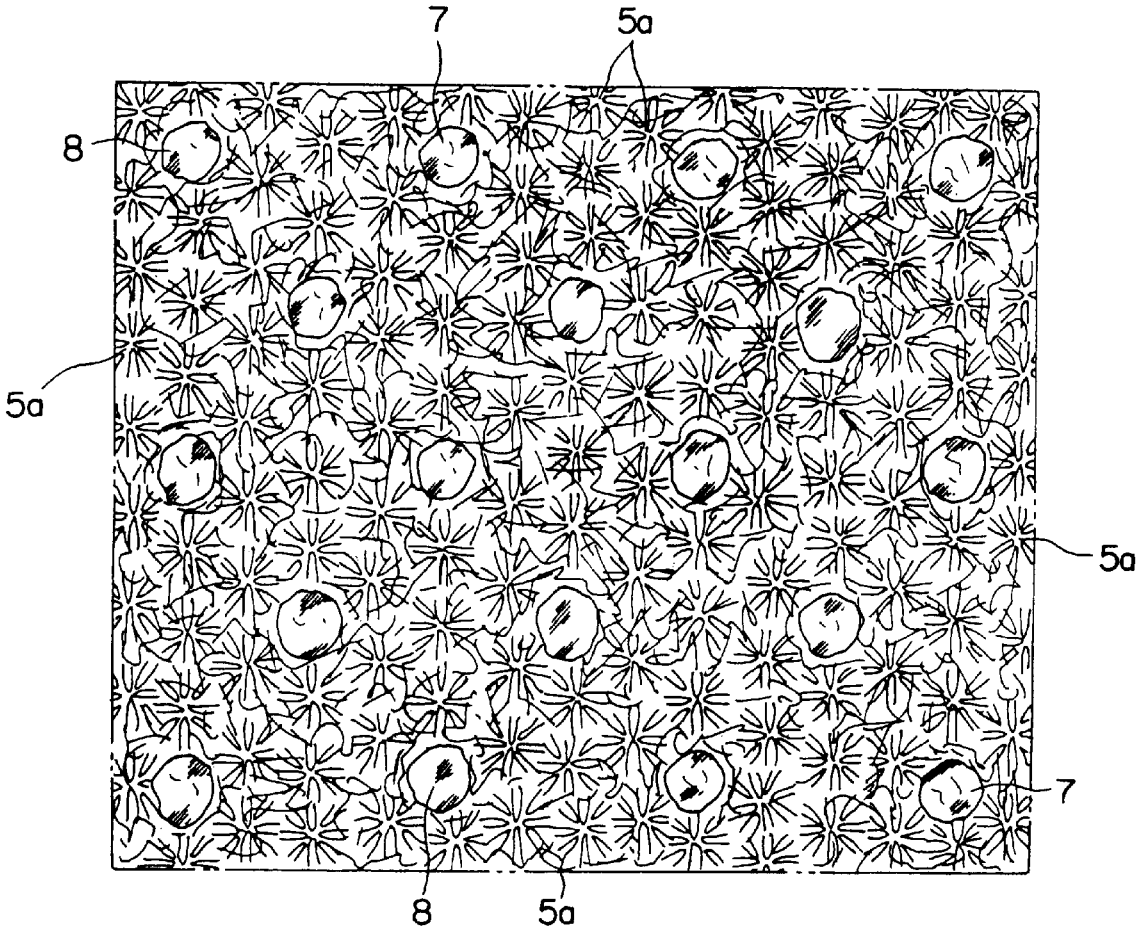
FIG. 9 is a diagram which shows the manner of dye migration and sublimation in a shibori clothing manufactured using cloth on which a polka-dot pattern has been print-dyed.
Figure 10:
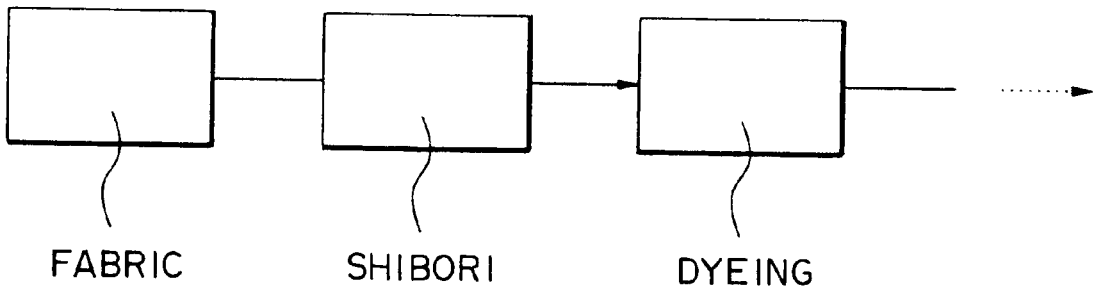
FIG. 10 is a diagram which schematically shows the flow of the "shibori (binding) process" of the "shibori dyeing" technique, which is a traditional Japanese dyeing method.

In FIG. 9, the condition of a cloth with which migration and sublimation has occurred is illustrated schematically for an example where the dye has migrated into a light-colored polka dot portion 9 from a surrounding dark-colored portion in a shibori clothing 4 on which a polka dot pattern has been print dyed. The clothing of FIG. 9 has crimps 5*a* formed by the above-described "thread tying method."

To give a more detailed description of the conditions of migration and sublimation, the dark-colored dye in the surroundings of a polka-dot pattern portion 7, which has been formed on the cloth by print dyeing and is of a lighter color than the surroundings, migrates into the polka-dot pattern portion to give rise to stain-like mark as indicated by symbol 8. This stain-like mark damages the beauty of a pattern, such as the polka-dot pattern, and thus causes the commercial value of shibori clothing 4 to drop.

In order to effectively prevent such dye migration and sublimation, the present inventor has carried out long years of experiments towards setting favorable conditions for the print dyeing process.

Figure 5:
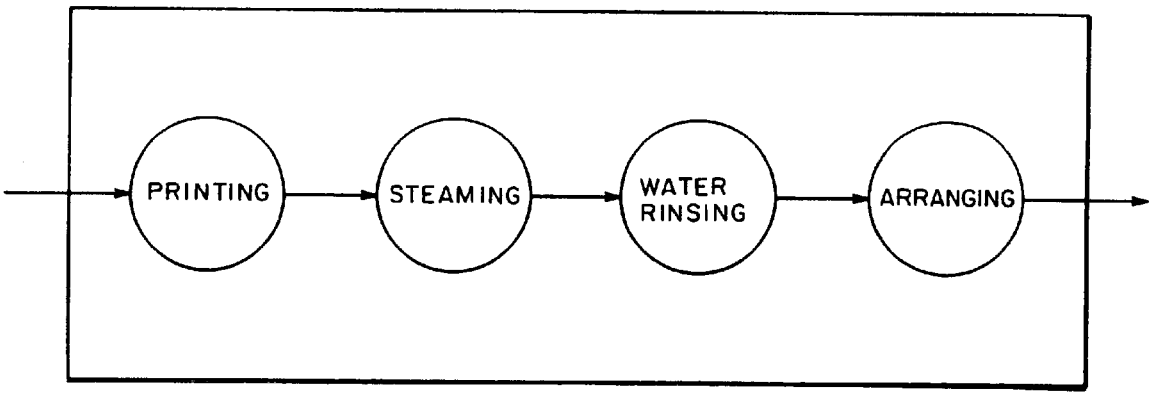
FIG. 5 is a diagram which schematically show the "print dyeing process" that can be employed in the same manufacturing process.

As a result, the inventor has come to propose that it is optimal for the "print dyeing process" to be comprised of the four processes of "print process," "steaming process," "water rinsing process," and "arranging process," as shown in FIG. 5 and for print dyeing to be performed using cation-dyeable polyester as the cloth material.

To be more specific, in this print dyeing process, a 2000-mesh screen is used and a hard (H) type spatula is used to scrape the screen. A dispersion-type cationic dye is used as the dye and a gum type sizing agent is used. In the "steaming process," an HT continuous steamer is used as the steam oven, the steam temperature is set to 115° C. to 125° C., and especially preferably 120° C., and exposure to steam is performed for 30 minutes continuously. Since cation-dyeable polyester textiles are more easily damaged in comparison to polyester for regular dyeing, the steam pressure is preferably set to 2 atmospheres or less.

In the subsequent "water rinsing process," an anionic soaping agent, to be more specific, soda ash ("Lacoal PSK," made by Meisei Chemical Industry Co., Ltd. is especially preferable) is used in place of a generally used basic detergent. After this water rinsing, hot water rinsing (temperature: 60° C.) is performed and reduction cleaning is performed for approximately 4 hours.

The sizing agent used in print dyeing is removed completely by this reduction cleaning. The cleaning time should be adjusted finely according to the color and pattern of the cloth.

The above-described print dyeing method or immersion dyeing method using a cation-dyeable polyester can prevent dye migration and sublimation not only in the manufacture of shibori clothes but also in crushed crimp processes and various other clothes manufacturing processes in which a heat treatment process is applied after the print dyeing process and is therefore a technique with a wide range of applications.

In the subsequent "arranging process," just an anti-static agent (for example, "Nice Pole PF 85," made by Nikka Chemical Industry Co., Ltd.) is used without using a softening agent or other chemicals and the cloth is hot dried and set for 1 minute under the temperature condition of 150° C.

This method has been confirmed to effectively prevent the dye migration and sublimation phenomenon in the "steam setting process" of the subsequent "setting process.

From the abovementioned experiments, the present inventor obtained the knowledge that the three following technical matters [(1) to (3)] are especially important as key points for effective prevention of dye migration and sublimation in print-dyed cation-dyeable polyester cloths.

Firstly, measure should be taken to make the sizing agent layer as thin as possible in the print dyeing process.

Secondly, the steam exposure conditions of the "steaming process" in the print dyeing process should be set to the conditions as described above.

Thirdly, the sizing agent should be removed completely by a soaping agent in the "water rinsing process" in the print dyeing process.

The abovementioned "setting process" for the case where a cloth made of a "natural textile" shall now be described mainly on the basis of FIGS. 4(A) to 4(C).

Figure 4A:
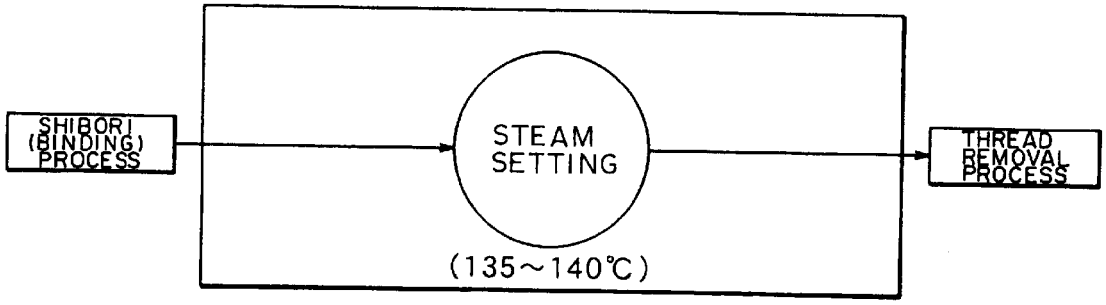
FIG. 4 (A) is a diagram which schematically shows the flow of the "setting process" for the case of a cloth made from natural fiber and shows the flow of a "setting process" that can be employed in the case of a cloth made from silk, cotton, or hemp.
FIG. 4(B) is a diagram which shows the flow of a "setting process" that can be employed in the case of a cloth made from wool.
FIG. 4(C) is a diagram which shows the flow of a "setting process" that can be employed in the case of a cloth made from cotton or hemp.
Figure 4B:
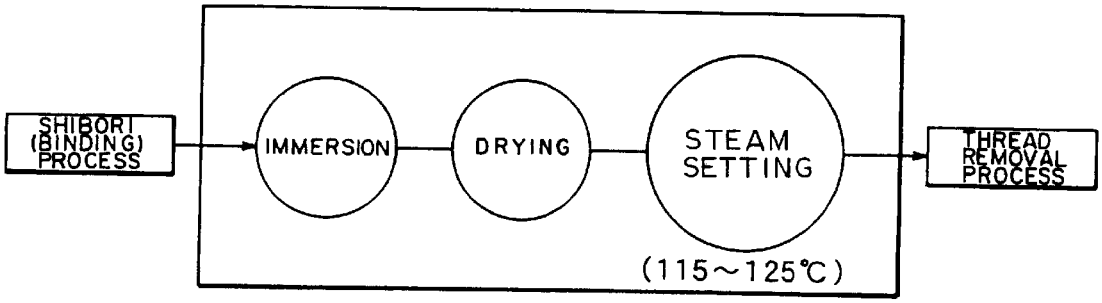

In the case where a cloth made from silk is to be used, the shibori cloth 3 (see FIG. 1) is transferred to the "setting process" after the "shibori (binding) process" and subject to the "steam setting process" (see FIG. 4(A)) as in the above-described case of a synthetic textile.

In the present case, the "steam setting process" is performed for 10 to 15 minutes under the steam temperature condition of 135° C. to 145° C., and preferably 140° C. The subsequent "drying process" is then omitted and the thread removing process is started. By employing such a method, the silk shibori clothing 4, which is the final product, can be made to have soft handling and draping qualities and provide high in comfort when worn.

In the case where a cloth made of wool is to be used, after the "shibori (binding) process" following the "sewing process," the shibori cloth is subject to a pretreatment comprised of a method in which the cloth is immersed in a 5 to 7% solution of mono-ethanol bisulfite ("Monamin BTN," made by Meisei Chemical Industry Co., Ltd. is especially favorable) at room temperature and then dried under a temperature condition of 70° C. to 80° C. The cloth is then transferred to the "setting process" and subject to the "steam setting process (see FIG. 4(B)). Here, the "steam setting process" is favorably performed for approximately 15 minutes under a steam temperature condition of 115° C. to 125° C., and preferably 120° C. The steam pressure for this process is preferably controlled to 1.8 atmospheres or less in order to avoid damage to the wool textile.

In the case where a cloth made of cotton or hemp is to be used, a shibori clothing 4 of good handling and draping qualities can be made by performing the "steam setting process" as the "setting process" as in the above-described case for cotton and hemp. With a cloth made of cotton or hemp, it has been found that shibori clothes can also be manufactured by setting the conditions of the "steam setting process" to a relatively high steam temperature of 150° C. and a steam pressure of 3 atmospheres.

Also for the case of cloth made of cotton or hemp, the present inventor has been able to propose a "setting process" in which a "steam setting process" is not employed.

Figure 4C:
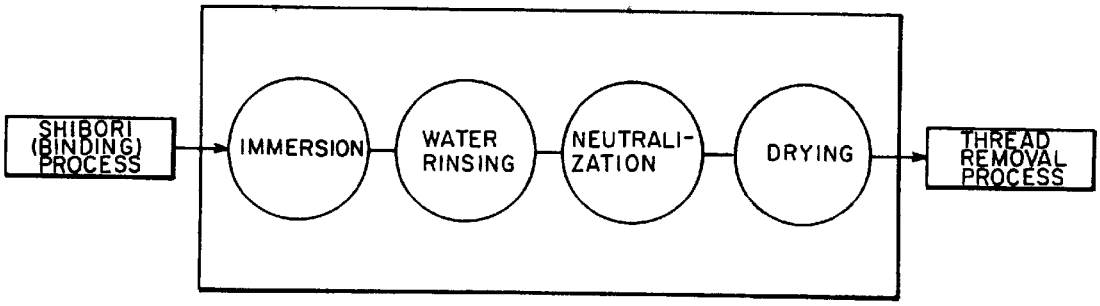

With this method, the cloth is immersed for 5 to 6 minutes in a sodium hydroxide solution of Baumé degree of 40, then rinsed in running water for 60 minutes or more, subject to neutralization treatment with an acetic acid solution of 3% concentration for 10 to 15 minutes, and dried (see FIG. 4(C)). It is especially favorable for the water rinsing in this "setting process" to be performed under running water conditions since non-uniformity of coloration due to the rubbing of cloth can be effectively prevented.

As has been described above, the shibori clothes manufacturing method of this invention may not only be applied to cloths of various materials but enables shibori forming work to be carried out securely without worry of dye migration and sublimation, even in the case of patterned cloth made by plain dyeing by immersion or print dyeing.

By the shibori clothes manufacturing method of this invention, crimps 5 can be formed without fail on a cloth made of synthetic textile or natural textile and shibori clothes that are soft and comfortable to wear can be provided.

What is claimed is:

1. A clothes manufacturing method comprising the sequential steps of:

dyeing a fabric cutting a pattern in said dyed fabric;

sewing said cut and dyed fabric into a garment;

pleating and gathering the fabric of said garment using a sewing needle to form shibori shapes;

setting said shibori shapes to maintain said shibori shapes in said garment, and removing said thread used to form said shibori shapes.

2. The clothes manufacturing method defined in claim 1, wherein said pleating and gathering step is performed by inserting said sewing needle horizontally around the fabric forming the garment such that the resulting shibori shapes are stretchable along a horizontal axis.

3. The clothes manufacturing method defined in claim 1, wherein said fabric is a cation-dyeable polyester, and said dyeing step is implemented by printing or immersing said fabric with a dispersion-type cationic dye.

4. The clothes manufacturing method defined in claim 1, wherein said fabric is formed from natural fibers, and said shibori setting consists only of steam setting.

5. The clothes manufacturing method defined in claim 1, wherein said fabric is formed from wool, and said shibori setting is performed by solution immersion of the fabric, drying of the fabric, and steam setting.

6. The clothes manufacturing method defined in claim 1, wherein said fabric is formed from cotton or hemp, and said shibori setting is performed by solution immersion of the fabric, water rinsing of the fabric, neutralization of the fabric, and drying.

7. The clothes manufacturing method defined in claim 2, wherein the entire surface of the fabric forming the garment is pleated and gathered to form shibori shapes.

* * * * *